US011299390B2

(12) United States Patent
Benetti

(10) Patent No.: US 11,299,390 B2
(45) Date of Patent: Apr. 12, 2022

(54) LOCKING HEADPLATE FOR A SADDLE TREE OF A RIDING SADDLE AND SADDLE TREE COMPRISING SUCH A HEADPLATE

(71) Applicant: AMAHORSE TRADING S.R.L., San Giustino (IT)

(72) Inventor: Mauro Benetti, San Giustino (IT)

(73) Assignee: AMAHORSE TRADING S.R.L., San Giustino (IT)

( * ) Notice: Subject to any disclaimer, the term of this patent is extended or adjusted under 35 U.S.C. 154(b) by 244 days.

(21) Appl. No.: 16/310,001

(22) PCT Filed: Jul. 11, 2017

(86) PCT No.: PCT/IB2017/054178
§ 371 (c)(1),
(2) Date: Dec. 14, 2018

(87) PCT Pub. No.: WO2018/011712
PCT Pub. Date: Jan. 18, 2018

(65) Prior Publication Data

US 2020/0317503 A1 Oct. 8, 2020

(30) Foreign Application Priority Data

Jul. 15, 2016 (IT) ..... 102016000074424

(51) Int. Cl.
*B68C 1/04* (2006.01)
*B68C 1/02* (2006.01)

(52) U.S. Cl.
CPC ..... *B68C 1/04* (2013.01); *B68C 1/025* (2013.01); *B68C 2001/046* (2013.01)

(58) Field of Classification Search
CPC ..... B64C 2001/042; B64C 2001/046; B64C 1/04; B64C 1/025; B68C 2001/042; B68C 2001/046; B68C 1/04; B68C 1/025
See application file for complete search history.

(56) References Cited

U.S. PATENT DOCUMENTS 38,404 A * 5/1863 Nichols ..... B68C 1/04 54/44.3
1,246,675 A * 11/1917 Stewart ..... B68C 1/02 54/44.1

(Continued)

FOREIGN PATENT DOCUMENTS

DE 202010010215 U1 11/2011
DE 202014105189 U1 * 8/2015 ..... B68C 1/04

(Continued)

OTHER PUBLICATIONS

International Search Report and Written Opinion for PCT/IB2017/054178 dated Jan. 4, 2018.

*Primary Examiner* — Magdalena Topolski
*Assistant Examiner* — Shada Mohamed Alghailani
(74) *Attorney, Agent, or Firm* — Thomas | Horstemeyer, LLP.

(57) ABSTRACT

A locking headplate of the configuration of the saddle tree of a riding saddle comprises two rigid headplate arms, each suitable for being fixed to a respective lateral front portion of the saddle tree. The two headplate arms have mutual connection end portions which form a headplate hinge for a rotation of one headplate arm with respect to the other about an axis of rotation. The end portions are further fitted with facing blocking surfaces shaped in a complementary manner so as to block, when placed in mutual contact, the rotation of the headplate arms. The headplate is further provided with arm translation means operable to translate one arm with respect to the other along the axis of rotation so as to cause the engagement and disengagement of said blocking surfaces, said arm translation means being accessible through a front access opening coaxial to the axis of rotation.

7 Claims, 4 Drawing Sheets

(56) References Cited

U.S. PATENT DOCUMENTS

| | | | | | |
|---|---|---|---|---|---|
| 3,388,530 | A * | 6/1968 | Parker | B68C 1/02 | 54/44.1 |
| 4,473,992 | A * | 10/1984 | Conger, III | B68C 1/04 | 54/46.2 |
| 4,996,827 | A * | 3/1991 | Pellew | B68C 1/04 | 54/44.3 |
| 8,230,666 | B2 | 7/2012 | Strauss et al. | | |
| 2010/0229507 | A1* | 9/2010 | Strauss | B68C 1/04 | 54/44.3 |
| 2017/0297893 | A1* | 10/2017 | Strauss | B68C 1/04 | |
| 2017/0313572 | A1* | 11/2017 | Aksoyek | B68C 1/12 | |

FOREIGN PATENT DOCUMENTS

| | | |
|---|---|---|
| FR | 15669 E | 8/1912 |
| GB | 18567 A | 8/1915 |

* cited by examiner

LOCKING HEADPLATE FOR A SADDLE TREE OF A RIDING SADDLE AND SADDLE TREE COMPRISING SUCH A HEADPLATE

CROSS-REFERENCE TO RELATED APPLICATION

This application is the 35 U.S.C. § 371 national stage application of PCT Application No. PCT/IB2017/054178, filed Jul. 11, 2017, where the PCT claims the priority to and benefit of Italian Patent Application No. 102016000074424, filed Jul. 15, 2016, both of which are herein incorporated by reference in their entireties.

The present invention relates to the field of riding accessories and relates to a locking headplate for a saddle tree of a riding saddle and to a saddle tree comprising such a headplate.

As is known, riding saddles are made on a substantially rigid frame, known as "saddle tree".

The saddle tree gives shape to the saddle and should follow the shape of the back of the horse as much as possible. The saddle tree has a front portion leaning on the withers of the horse. This front portion has, when viewed from the front, an inverted "V" shape. That is, the front portion comprises two lateral portions to which the abutments for the straps surrounding the horse's body are fixed.

Since of course there are different sizes of horses, and even horses of similar size can have a different conformation, there are saddle trees in different sizes.

To overcome the problem of having to have different saddle trees to ride different horses, adjustment mechanisms to be installed between the lateral portions of the saddle tree have been proposed. An example of such mechanisms is described in U.S. Pat. No. 8,230,666B2

These adjustment mechanisms have however reduced reliability, since the various gears and moving parts they are provided with can easily jam, mainly due to dirt with which they may come into contact during use.

Another limitation of known mechanisms is that the adjustment should be carried out necessarily with the saddle tree mounted upside down. It is therefore impossible to make the adjustment with the saddle tree on the horse.

The object of the present invention is to propose a locking headplate for a saddle tree that is more reliable than the known adjustment mechanisms and suitable to be operated also with the rider already on the saddle, allowing verification of the desired adjustment.

Said object is achieved with a locking headplate according to claim 1 and with a saddle tree according to claim 7. The dependent claims describe preferred embodiments of the invention.

The features and the advantages of the locking headplate and of the saddle tree according to the invention shall be made readily apparent from the following description of preferred embodiments thereof, provided purely by way of a non limiting example, with reference to the accompanying figures, in which:

FIGS. 1 and 1*a* are two perspective exploded front and rear views of the locking headplate according to the invention;

Figure 1:
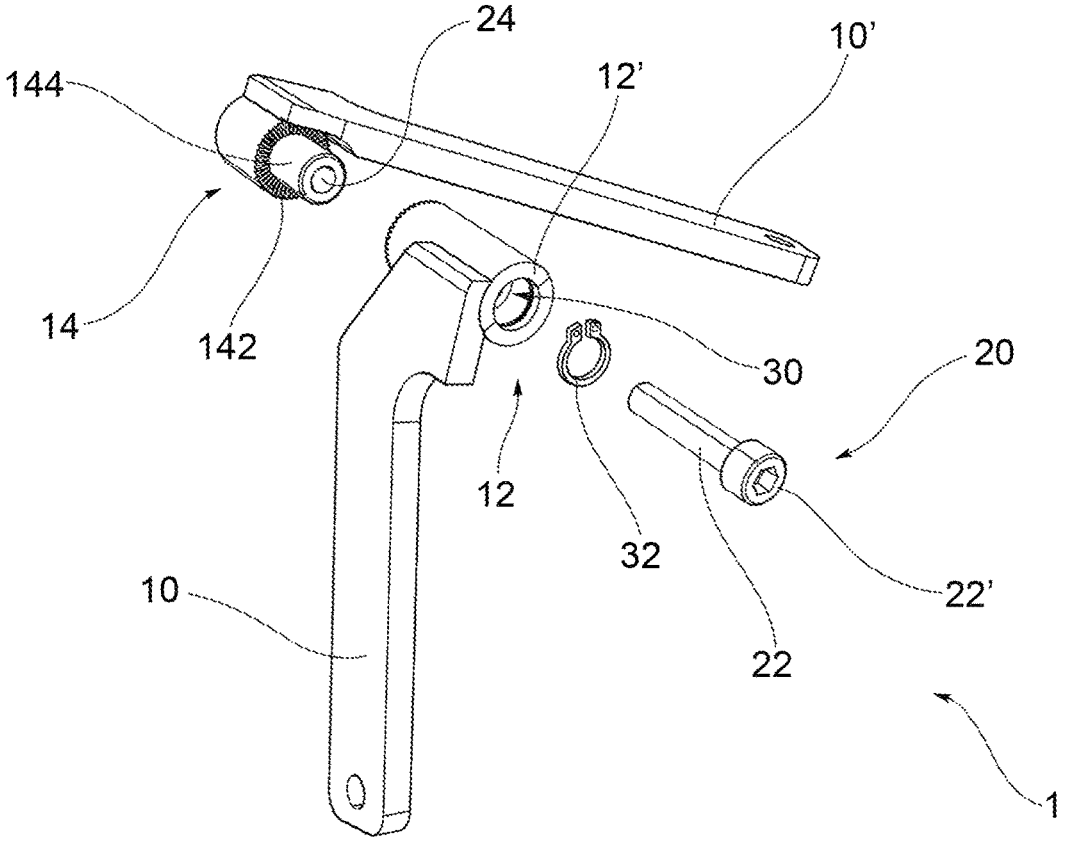
Figure 1A:
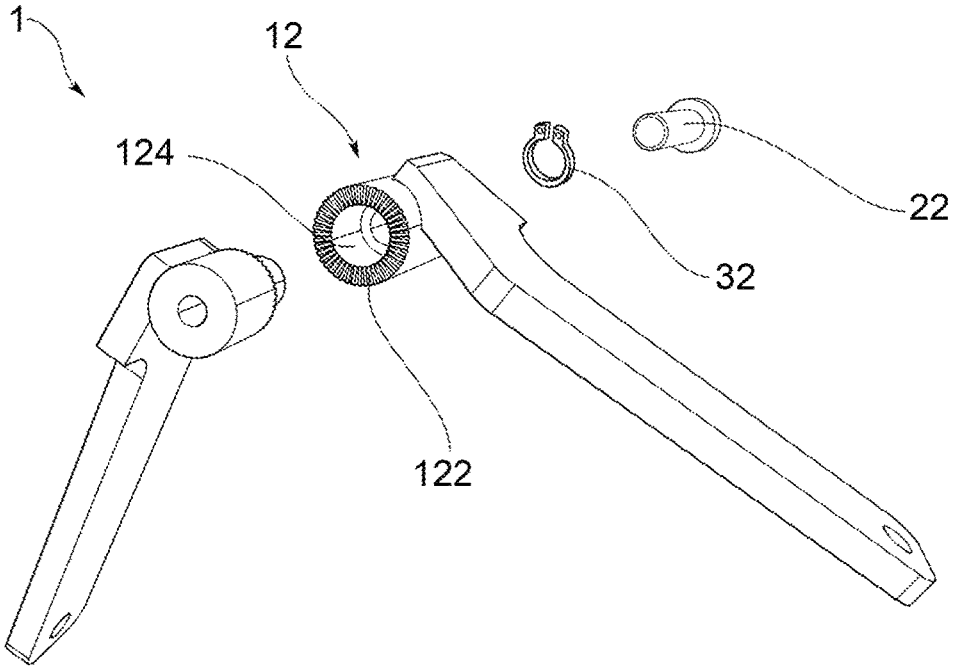
Figure 2:
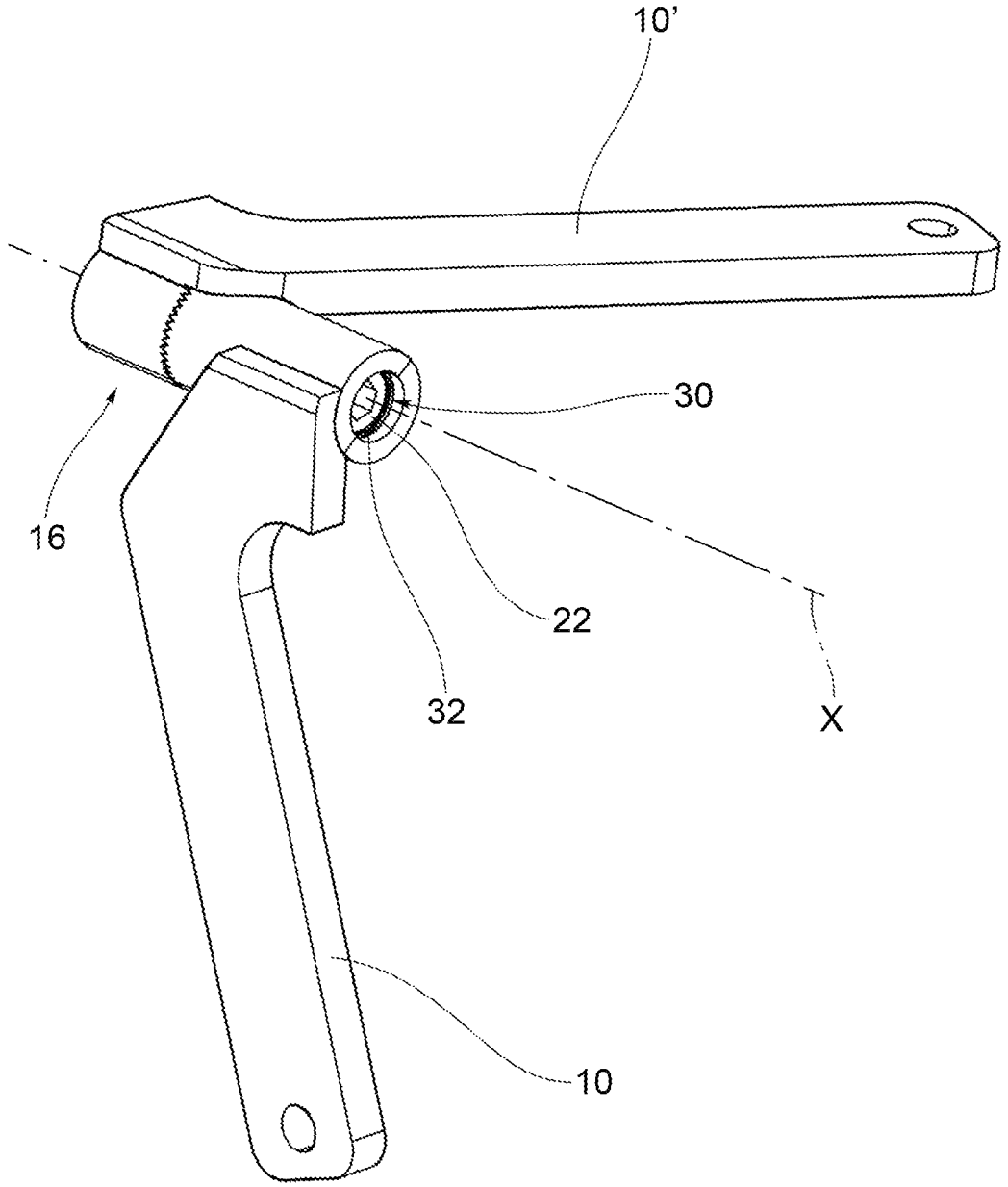
FIG. 2 is a perspective view of the assembled locking headplate in a locking configuration of the headplate arms.
Figure 3:
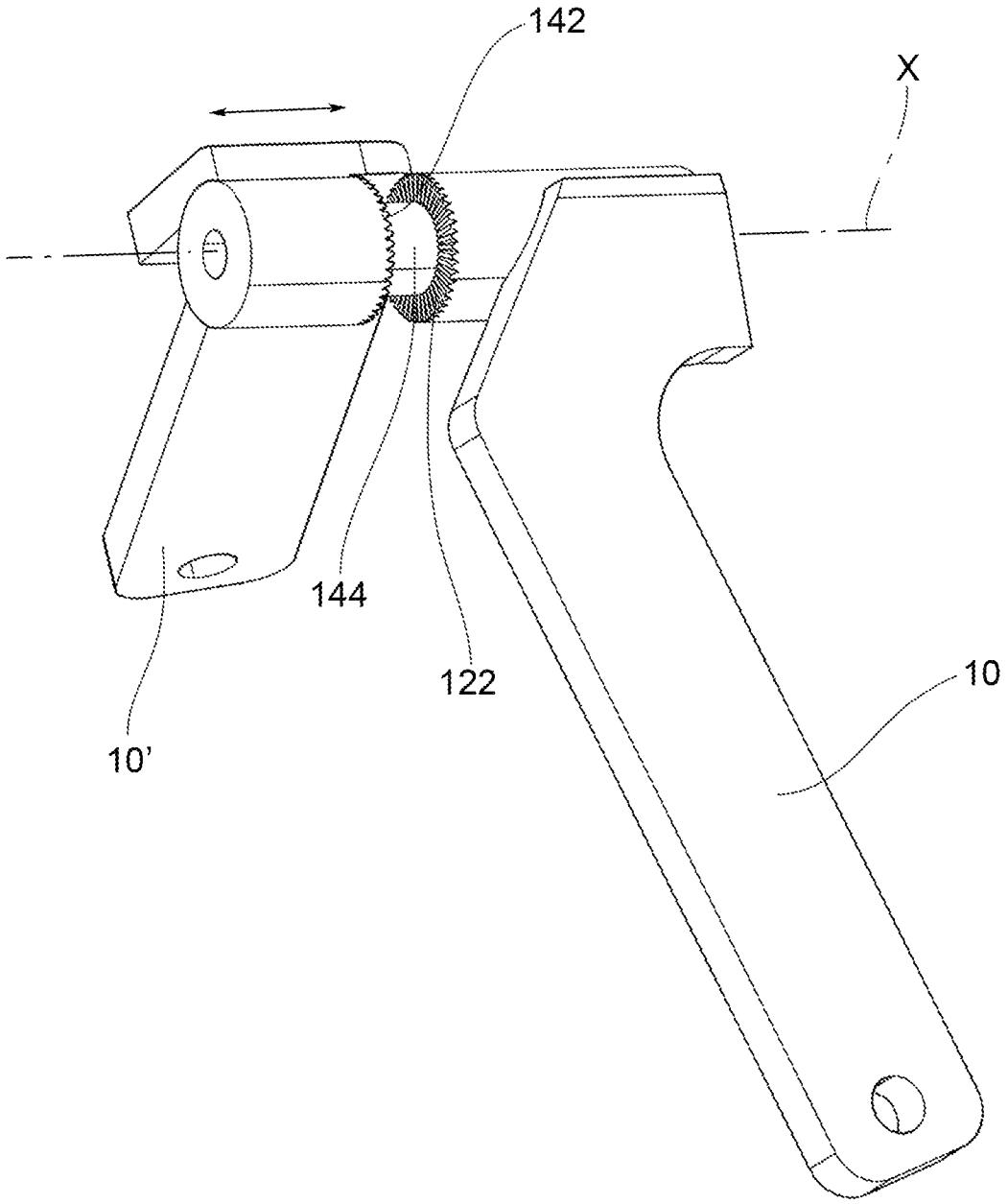
FIG. 3 is a perspective view of the assembled locking headplate in a release configuration of the arms.

In said drawings, reference numeral 1 indicates as a whole a locking headplate suitable for varying the configuration of a saddle tree. In particular, the headplate allows adjusting the opening of the front side portions 102 of a saddle tree 100.

Headplate 1 comprises two rigid headplate arms 10, 10', each adapted to be fixed to the inner side of a respective front side portion 102 of the saddle tree 100.

In a general embodiment, the two headplate arms 10, 10' have mutual connection end portions 12, 14 which form a headplate hinge 16 for a rotation of one headplate arm with respect to the other about an axis of rotation X.

The end portions 12, 14 are further fitted with facing blocking surfaces 122, 142 shaped in a complementary manner so as to block, when placed in mutual contact, the rotation of the headplate arms 10, 10'.

Headplate 1 is further provided with arm translation means 20 operable to translate one arm 10 with respect to the other arm 10' along the axis of rotation X so as to cause the engagement and disengagement of the facing blocking surfaces 122, 142.

The arms translation means 20 are accessible through a front access opening 30 coaxial to the axis of rotation X. By the term "front" it is meant that, when headplate 1 is assembled on the saddle tree 100, such access opening 30 is facing towards the front end of the saddle tree 100.

In one embodiment, an end portion 12 comprises a hollow tubular element 124; the other end portion 14 comprises a pin 144 which is inserted in such a hollow tubular element 124.

In one embodiment, a blocking surface 122 is formed in the annular end surface of the hollow tubular element 124, facing towards the other end portion 14. The other blocking surface 142 is formed in an annular wall surrounding the base of pin 144 and which, when pin 144 is fully inserted into the hollow tubular element 124, abuts against the end surface of the hollow tubular element 124.

In one embodiment, the blocking surfaces 122, 142 are serrated surfaces, i.e. they have a plurality of radial projections which alternate with radial valleys.

In one embodiment, the arms translation means 20 comprise a screw 22 housed without the possibility of axial translation in one of the end portions 12, 14. Screw 22 is screwed into a threaded hole 24 formed in the other one of the end portions 12, 14. Since screw 2 is locked axially, a rotation thereof necessarily causes an axial translation of the arm with respect to the other.

For example, screw 22 is housed in the end portion 12 comprising the hollow tubular element 124; the threaded hole 24 is made in pin 144 of the other end portion 14.

More in detail, screw 22 has a head 22' housed in the front access opening 30. The front access opening 30 is thus formed in the end portion 12 crossed by screw 22. In this case, the end portion 12 comprises a front portion 12' in which the front access opening 30 is formed and a rear access portion that forms the hollow tubular element 124.

In one embodiment, head 22' of screw 22 is axially blocked in the front access opening 30 by means of a seeger 32.

An object of the present invention is also a saddle tree 100 provided with headplate 1 described above.

The saddle tree 100 comprises a saddle tree body 101 having a front portion 101' adapted to abut on the withers of a horse. This front portion 101' comprises two side portions 102, inclined and converging upwardly. Each arm 10, 10' of headplate 1 is fixed to the inner side of a respective side portion 102 of the saddle tree.

In one embodiment, at the front end of the saddle tree body 101, between the two side portions 102, a recess 103 is formed which surrounds the end portions 12, 14 of the headplate arms.

In other words, the front access opening 30 is located substantially aligned with the upper surface of the saddle tree 100, thus in a portion such that it is possible to actuate the arm translation means 20 also while sitting on the saddle, exploiting the space between the front end and of the saddle tree and the horse's neck.

It should be noted that in a preferred embodiment, headplate 1 is fixed to the saddle tree 100 only by means of arms 10, 10'.

In one embodiment, at least the front portion 101' of the saddle tree body 101 is made of a material and/or of a thickness such as to allow a further divergence of the side portions 102 with respect to the inclination at rest of said side portions 102, under the action of a pressure exerted thereon.

For example, such a front portion 101' of the saddle tree is made of a plastic material.

In other words, exerting a force from above downwards on the saddle tree 100 causes an opening of the side portions 102 of the saddle tree 100 when these are resting on a supporting surface or when the saddle tree 100 is positioned on the back of the horse.

Figure 4:
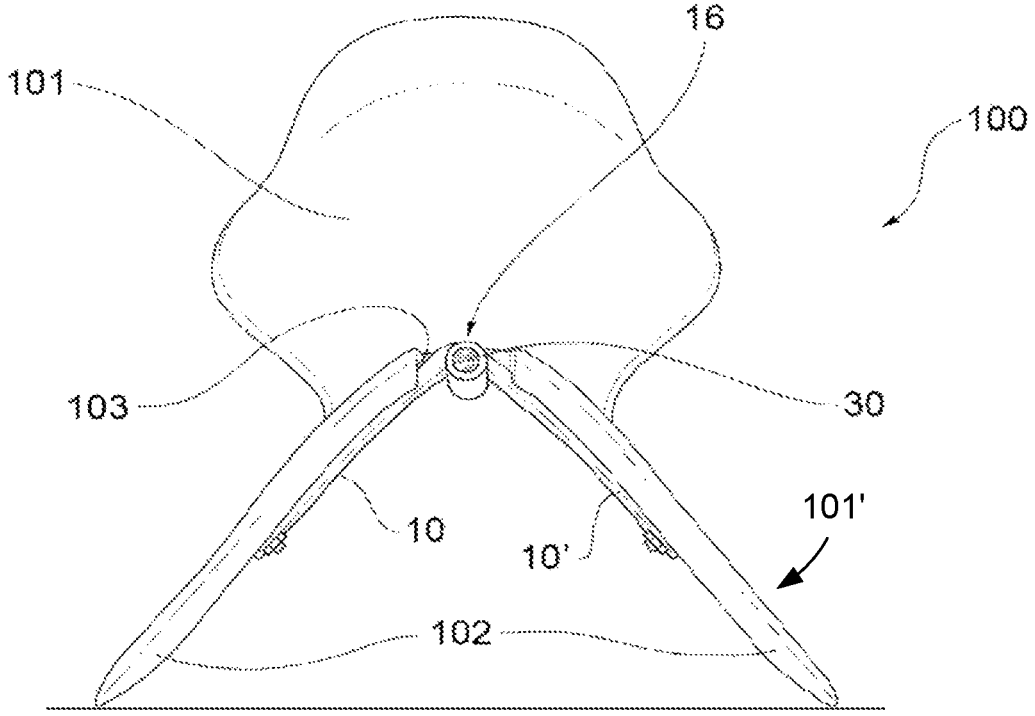
FIG. 4 shows the headplate assembled on the saddle tree, with the saddle tree in an initial configuration.
Figure 5:
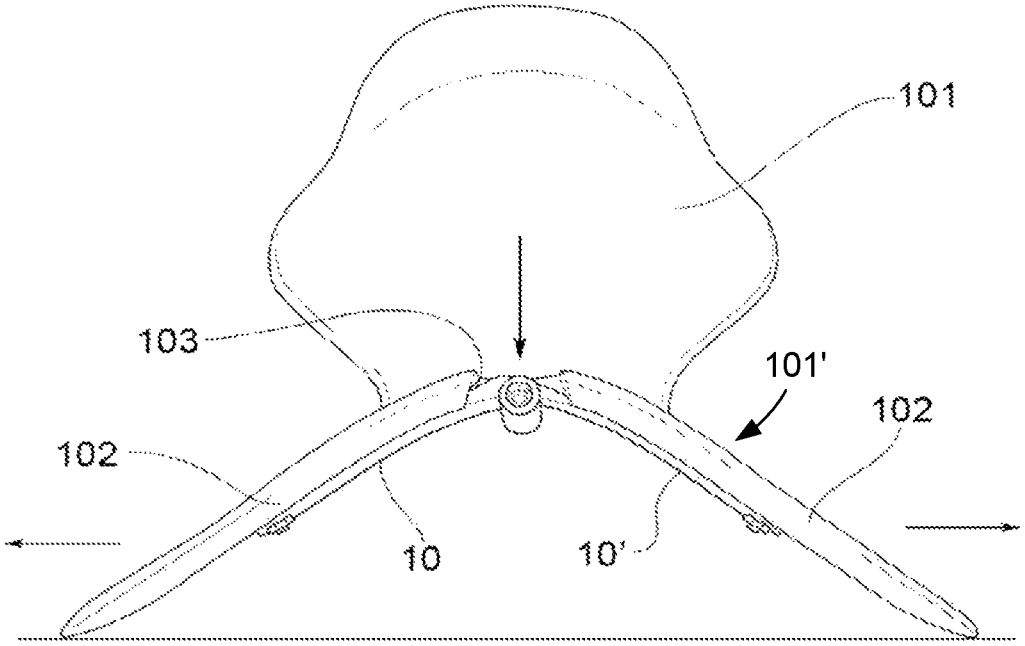
FIG. 5 shows the headplate in an adjusted configuration.

When headplate 1 is assembled to the saddle tree 100, in order to cause the divergence or spreading of the side portions 102, starting from a rest position it is necessary that the blocking surfaces 122, 142 of the headplate are separated from each other by acting on the arm translation means 20 (FIG. 4), for example by turning screw 22 with a tool. In this way, arms 10, 10' are free to rotate following the inclination of the side portions 102 of the saddle tree.

At this point, it is possible to apply the pressure on the saddle tree up to find the most suitable configuration for the horse. Once the final configuration has been selected, it is sufficient to approach the blocking surfaces 122, 142 to securely lock the arms 10, 10' into position, for example by turning screw 22 with the tool in the opposite direction.

In an alternative embodiment, the side portions 102 of the saddle tree 100 are hinged together.

In any case, the adjustment system of the saddle tree configuration exploits the ability of the saddle tree itself to vary the inclination of the front side portions 102 when it is subjected to a pressure.

The locking headplate 1 thus has a particularly simple structure, formed by a reduced number of components, and therefore particularly reliable and safe.

The headplate according to the invention allows carrying out a fine adjustment of the saddle tree configuration. In particular, this adjustment can be carried out while sitting on the saddle, and thus identifying the best configuration of the saddle tree directly adapting it to the size and conformation of the horse.

The same weight of the rider facilitates the adjustment and the balance of the saddle on the horse's back, distributing the resulting weight and pressure in a uniform manner for optimal comfort of the horse and rider.

A man skilled in the art may make several changes, adaptations and replacements of elements with other functionally equivalent ones to the embodiments of the locking headplate and of the saddle tree according to the invention in order to meet incidental needs, without departing from the scope of the following claims. Each of the features described as belonging to a possible embodiment can be obtained independently of the other embodiments described.

The invention claimed is:

1. A saddle tree comprising: a saddle tree body having a front portion suitable to abut on the withers of a horse, said front portion comprising two inclined side portions converging upwardly, wherein an inclination of said inclined side portions is variable when the saddle tree is positioned on the back of the horse;

and a locking headplate comprising two rigid headplate arms, each headplate arm being fixed to an inner side of the respective inclined side portion, the two headplate arms having respective mutual connection end portions which form a headplate hinge for a rotation of one headplate arm with respect to the other headplate arm about an axis of rotation, wherein the two inclined side portions are hinged together, wherein said end portions are further fitted with facing blocking surfaces shaped in a complementary manner so as to block, when placed in mutual contact, the rotation of the headplate arms, the locking headplate being further provided with arm translation means operable to translate one arm with respect to the other along the axis of rotation so as to cause engagement and disengagement of said blocking surfaces, said arm translation means comprising a screw and being accessible through a front access opening coaxial to the axis of rotation, wherein one end portion of said end portions comprises a hollow tubular element, and wherein the other end portion of said end portions comprises a pin which is inserted in said hollow tubular element;

wherein a first blocking surface of said blocking surfaces is formed in an annular end surface of the hollow tubular element and a second blocking surface is formed in an annular wall surrounding a base of the pin, and wherein the first blocking surface faces the second blocking surface;

and said arm translation means configured to be actuated by a rider to change the inclination of the two headplate arms while the rider is sitting on the saddle positioned on the back of the horse.

2. The saddle tree according to claim 1, wherein at least the front portion of the saddle tree body is made of a material and/or of a thickness such as to allow a further divergence of the side portions with respect to the inclination at rest of said side portions, under an action of a pressure exerted on them.

3. The saddle tree according to claim 1 wherein when the pin is fully inserted into the hollow tubular element, the second blocking surface abuts against the annular end surface of the hollow tubular element.

4. The saddle tree according to claim 1, wherein said arm translation means comprise the screw housed in one end portion of said end portions and blocked from axial translation in the one end portion, and a threaded hole made in the other end portion of said end portions, the threaded hole configured to receive the screw.

5. The saddle tree according to claim 1, wherein one end portion of said end portions comprises a hollow tubular element, and wherein the other end portion of said end portions comprises a pin which is inserted in said hollow tubular element, wherein said arm translation means comprise the screw housed in the one end portion comprising the hollow tubular element and blocked from axial translation in the one end portion, and a threaded hole made in the pin of the other end portion, the threaded hole configured to receive the screw.

6. The saddle tree according to claim 4, wherein the screw comprises a head, the head of the screw is housed in said front access opening.

7. The saddle tree according to claim 6, wherein the head of the screw is axially blocked in the front access opening by means of a seeger.

* * * * *